US010823176B2

(12) United States Patent
Gu et al.

(10) Patent No.: US 10,823,176 B2
(45) Date of Patent: Nov. 3, 2020

(54) VARIABLE SPEED PUMPING CONTROL SYSTEM WITH ACTIVE TEMPERATURE AND VIBRATION MONITORING AND CONTROL MEANS

(71) Applicant: FLUID HANDLING LLC, Morton Grove, IL (US)

(72) Inventors: James J. Gu, Buffalo Grove, IL (US); Andrew A. Cheng, Wilmette, IL (US)

(73) Assignee: FLUID HANDLING LLC, Morton Grove, IL (US)

( * ) Notice: Subject to any disclaimer, the term of this patent is extended or adjusted under 35 U.S.C. 154(b) by 0 days.

(21) Appl. No.: 16/535,773

(22) Filed: Aug. 8, 2019

(65) Prior Publication Data

US 2020/0049152 A1 Feb. 13, 2020

Related U.S. Application Data

(60) Provisional application No. 62/716,027, filed on Aug. 8, 2018.

(51) Int. Cl.

| | |
|---|---|
| ***F04B 49/20*** | (2006.01) |
| ***F04D 15/00*** | (2006.01) |
| ***F04D 15/02*** | (2006.01) |

(52) U.S. Cl.

CPC ..... *F04D 15/0027* (2013.01); *F04D 15/0066* (2013.01); *F04D 15/0254* (2013.01); *F04D 15/0263* (2013.01)

(58) Field of Classification Search

CPC ..... F04D 15/0027; F04D 15/0254; F04D 15/0263; F04D 15/0066; F04D 29/669; F04B 49/20

See application file for complete search history.

(56) References Cited

U.S. PATENT DOCUMENTS 4,965,713 A 10/1990 Hong et al.
5,044,888 A 9/1991 Hester, II
(Continued)

FOREIGN PATENT DOCUMENTS

JP 2000110769 A 4/2018
WO 2010126847 A1 11/2010
(Continued)

OTHER PUBLICATIONS

Mollazade, Kaveh, et al., "An Intelligent Combined Method Based on Power Spectral Density, Decision Trees and Fuzzy Logic for Hydraulic Pumps Fault Diagnosis," International Journal of Mechanical and Mechatronics Engineering, vol. 2; No. 8, 2008, pp. 986-998. http://waset.org/publications/1704.
(Continued)

*Primary Examiner* — Peter J Bertheaud
*Assistant Examiner* — Dnyanesh G Kasture
(74) *Attorney, Agent, or Firm* — Ware, Fressola, Maguire & Barber LLP

(57) ABSTRACT

Apparatus, including a pump system, features a controller having a signal processor or processing module configured to:

receive signaling containing information about a relationship between frequencies of pump vibration resonances detected around critical pump speeds and a 3-dimensional pump vibration power spectrum in the frequency domain with respect to pump speed and pump temperature change differences; and determine corresponding signaling containing information to adjust the pump speed to avoid the pump vibration resonances around the critical pump speeds, based upon the signaling received.

(Continued)

The signal processor or processing module is also configured to provide the corresponding signaling as control signaling to adjust the pump speed.

20 Claims, 2 Drawing Sheets

(56) References Cited

U.S. PATENT DOCUMENTS

| | | | | |
|---|---|---|---|---|
| 6,260,004 | B1 | 7/2001 | Hays et al. | |
| 6,330,525 | B1 | 12/2001 | Hays et al. | |
| 6,882,960 | B2 | 4/2005 | Miller | |
| 7,284,709 | B2 | 10/2007 | Guyer | |
| 7,539,549 | B1 | 5/2009 | Discenzo et al. | |
| 7,623,986 | B2 | 11/2009 | Miller | |
| 7,664,618 | B2 | 2/2010 | Cheung et al. | |
| 7,979,240 | B2 | 7/2011 | Fielder | |
| 8,401,806 | B2 | 3/2013 | Borsting et al. | |
| 8,914,300 | B2 | 12/2014 | Sustaeta et al. | |
| 9,169,707 | B1 | 10/2015 | Gilstad et al. | |
| 9,476,417 | B2 | 10/2016 | Kyllingstad et al. | |
| 9,612,182 | B2 | 4/2017 | Olde et al. | |
| 9,720,424 | B2 | 8/2017 | Ige et al. | |
| 9,746,199 | B1 | 8/2017 | Drees et al. | |
| 9,970,278 | B2 | 5/2018 | Broussard et al. | |
| 2006/0198744 | A1* | 9/2006 | Lifson | F04B 35/04 417/423.1 |
| 2010/0300683 | A1* | 12/2010 | Looper | E21B 21/06 166/250.01 |
| 2014/0056720 | A1 | 2/2014 | Jackle et al. | |
| 2014/0244051 | A1* | 8/2014 | Rollins | F04D 25/0606 700/282 |
| 2015/0211511 | A1 | 7/2015 | Koehl | |
| 2016/0123318 | A1 | 5/2016 | Villareal et al. | |
| 2018/0113481 | A1 | 4/2018 | Faiczak | |
| 2018/0128705 | A1 | 5/2018 | Wetherill et al. | |

FOREIGN PATENT DOCUMENTS

| | | | |
|---|---|---|---|
| WO | 2013040853 | A1 | 3/2013 |
| WO | 2016127136 | A1 | 8/2016 |

OTHER PUBLICATIONS

English language Abstract of JP2000110769A1, published Apr. 18, 2018.

English language Abstract of WO2013040853, published Mar. 28, 2013.

* cited by examiner

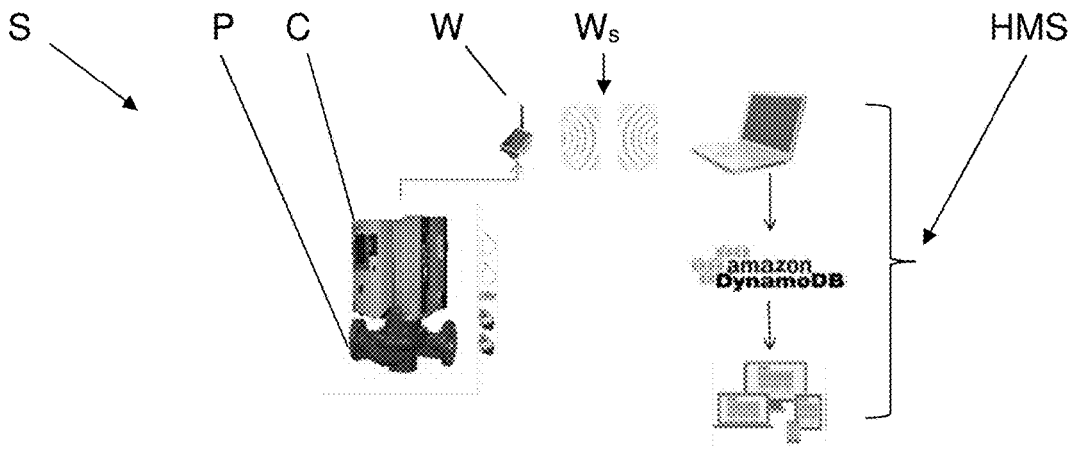
Figure 1. A pump Active vibration control and health monitoring system.
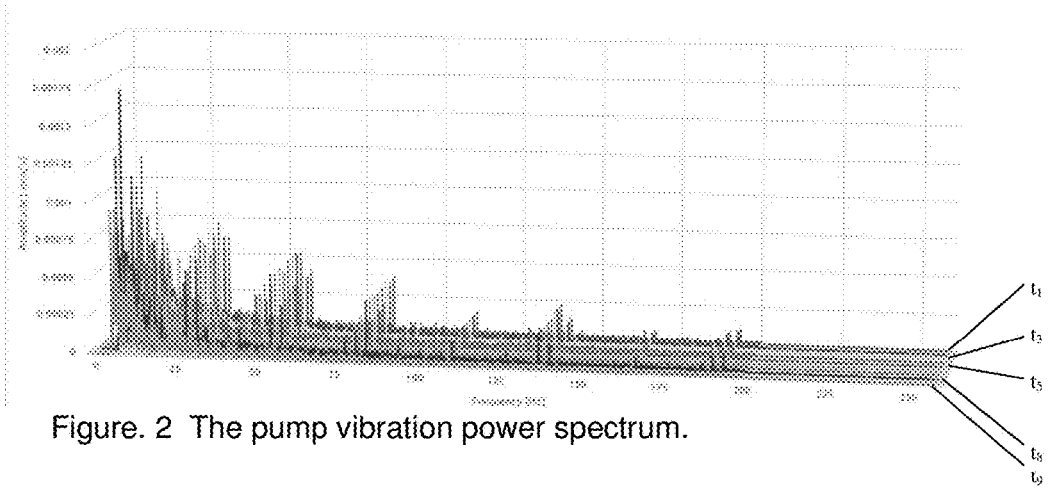
Figure. 2 The pump vibration power spectrum.
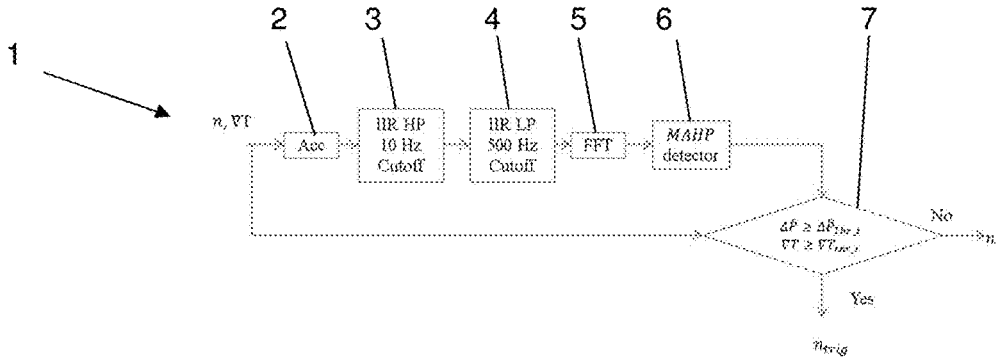
Figure 3. The flow chart and modules of the active pump control signal processing.

Apparatus 10, including a pump system,

A controller 11 having a signal processor or signal processing module10a configured at least to:

receive signaling containing information about receive signaling containing information about a relationship between frequencies of pump vibration resonances detected around critical pump speeds and a 3-dimensional pump vibration power spectrum in the frequency domain with respect to pump speed and pump temperature change differences;

determine corresponding signaling containing information to adjust the pump speed to avoid the pump vibration resonances around the critical pump speeds, based upon the signaling received; and/or provide the corresponding signaling as control signaling to adjust the pump speed.

Other signal processor circuits, circuitry, or components 10b that do not form part of the underlying invention, e.g., including input/output modules/modems, one or more memory modules (e.g., RAM, ROM, etc.), data, address and control busing architecture, etc.

Other circuitry and components 10c, including sensors for detecting pump speed, pump temperature, e.g., such as accelerometers, thermisters, etc.

Figure 4

VARIABLE SPEED PUMPING CONTROL SYSTEM WITH ACTIVE TEMPERATURE AND VIBRATION MONITORING AND CONTROL MEANS

CROSS-REFERENCE TO RELATED APPLICATION

This application claims benefit to provisional patent application Ser. No. 62/716,027, filed 8 Aug. 2018, which is hereby incorporated by reference in its entirety.

BACKGROUND OF THE INVENTION

1. Field of the Invention

The present invention relates to a pumping system; and more particularly relates to a pumping system having a controller.

2. Brief Description of Related Art

In the Variable Speed Pumping application monitoring pump system vibration level and elevated motor temperature have become critical elements to expand pumping system life expediency and reducing the energy consumption. These elements are especially important to be controllable in the pumping application where over speed operation is engaged.

SUMMARY OF THE INVENTION

The present invention provides an active pumping vibration control technique for a variable speed pumping system, in which resonances around critical speeds are detected and avoided automatically by adjusting pump speed accordingly. The present invention also provides failure detection and alarm criterions with a real time graphic display.

For an over speed pump operation that is now practiced in some specific applications, both the temperature and overall vibration may be raised. The active pump vibration control may also be applied in these speed regions by checking upon the vibration resonances as well as the overall power spectra rising levels respectively to protect pumps from failure. The system dynamic analysis data is acquired for the pump together with hydronic system and integrated to the control system, which shows the exact relationship between the parts and the bands alarmed, to pin point a failure mode with a specific part for calling a service.

SPECIFIC EMBODIMENTS

According to some embodiments, the present invention may take the form of apparatus featuring a controller having a signal processor or processing module configured to:

- receive signaling containing information about a relationship between frequencies of pump vibration resonances detected around critical pump speeds and a 3-dimensional pump vibration power spectrum in the frequency domain with respect to pump speed and pump temperature change differences; and
- determine corresponding signaling containing information to adjust the pump speed to avoid the pump vibration resonances around the critical pump speeds, based upon the signaling received.

The apparatus may also include one or more of the following features:

The signal processor or processing module may be configured to provide the corresponding signaling as control signaling to adjust the pump speed.

The apparatus may include a variable speed pumping control system.

The controller may include a moving average historic peak detector configured to

- receive associated signaling containing information about the pump speed, the frequencies of the pump vibration resonances detected, and the pump temperature change differences, and
- detect and provide moving average historic peaks.

The moving average historic peak detector may be a 3-dimensional moving average historic peak detector.

The 3-dimensional pump vibration power spectrum of P with respect to the pump speed of the frequency domain of f and the temperature change difference of ∇T may take the form of the following equation:

$$P(n,f,\nabla T)=\varphi(n,f,\nabla T), \tag{1}$$

where the expression $\varphi(n,f,\nabla T)$ is a 3-dimensional power spectra distribution with respect to pump speed of n, time and temperature change difference of ∇T, respectively.

The controller may include a moving average historic peak detector configured to obtain moving average historic peaks over frequency of f in the frequency domain, using the equation:

$$\hat{P}(n_i, \nabla T)=\hat{\varphi}(n_i,MAHP(f_i\pm\Delta f,\nabla t,\nabla T)), \tag{2}$$

where $n_i=0, \ldots, n_{max}$ within a speed region, $MAHP(f_i\pm\Delta f, \nabla t,\nabla T)$ is a 3-dimensional moving average historic peak detector with its center frequency at $f_i$ which is associated with a given pump speed of $n_i$, and with filter lengths of $\pm\Delta f$ along frequency, ∇t along time, and the temperature change difference of ∇T, where the 3-dimensional power spectra distribution is combined over fractional octave bands with respect to the pump speed of n.

The controller may be configured to implement an active vibration control with respect to the pump speed of n based upon Eq. 2 as follows:

fixing the pump speed of n at a value of $n_{tria}$, as $$n=n_{tria} \tag{3}$$

determining when a power spectrum jump of $\Delta\hat{P}$ is greater than a power spectra threshold value of $\Delta\hat{P}_{Thr\ i}$ set for detecting a resonance at a band of i, based upon the relationship:

$$\Delta\hat{P}\geq\Delta\hat{P}_{Thr\ i}; \tag{4}$$

defining a temperature criterion as $$\nabla T\geq\nabla T_{thr\ i}, \tag{5}$$

where $\nabla T_{thr\ i}$ is a temperature change threshold value set up; and defining the power spectrum jump of $\Delta\hat{P}$ by the equation:

$$\Delta\hat{P}(n_i, \nabla T)=abs(\hat{\varphi}(n_i,\nabla T)-\overline{\varphi}), \tag{6}$$

where $\Delta\hat{P}$ is the power spectrum jump in between $\hat{\varphi}$ at speed of $n_i$ and ∇T, $\overline{\varphi}$ is an overall average power spectra along the pump speed of n, at a time of t, and over the temperature change difference of ∇T, respectively.

The controller may be configured to implement the active vibration control by resuming the pump speed of n whenever there is no resonance triggered if $\Delta\hat{P}<\Delta\hat{P}_{Thr\ i}$, and setting the trig flag from "true" to "false", respectively.

The signal processor or processing module may be configured to provide the corresponding signaling as control signaling to control the operation of a pumping system, including staging/destaging a pump to or from the pumping system.

The Method

According to some embodiments, the present invention may include, or take the form of, a method featuring steps for:

receiving, with a controller having a signal processor or processing module, signaling containing information about a relationship between frequencies of pump vibration resonances detected around critical pump speeds and a 3-dimensional pump vibration power spectrum in the frequency domain with respect to pump speed and pump temperature change differences; and determining, with the controller, corresponding signaling containing information to adjust the pump speed to avoid the pump vibration resonances around the critical pump speeds, based upon the signaling received.

The method may also include one or more of the features set forth herein.

BRIEF DESCRIPTION OF THE DRAWING

The drawing, which is not necessarily drawn to scale, includes the following Figures:

FIG. 1 is a pump active vibration control and health monitoring system, e.g., adapted or configured with a pump active vibration control adapted on a pump, in which resonances around critical speeds are detected and avoided automatically by adjusting pump speed, according to some embodiments of the present invention.

FIG. 2 is a graph of a 3-dimensional pump vibration power spectrum in the frequency domain that includes 9 different pump vibration power spectrums of resonances sensed or detected in relation to 9 different time slots for a pump, each pump vibration power spectrum showing amplitude (mm/sec) versus frequency (Hz) of the resonances sensed or detected in a respective time slot for the pump, according to some embodiments of the present invention.

FIG. 3 is a flow chart and modules of an active pump control signal processing, according to some embodiments of the present invention.

FIG. 4 is a block diagram of apparatus, e.g., including a pumping system, according to some embodiments of the present invention.

Similar parts or components in Figures are labeled with similar reference numerals and labels for consistency. Every lead line and associated reference label for every element is not included in every Figure of the drawing to reduce clutter in the drawing as a whole.

DETAILED DESCRIPTION OF THE INVENTION

1. Introduction

Pumps are essential to Heating or cooling facility operation. Pre-engineered Pump Health Monitoring solutions, such as a vibration monitoring system, deliver diagnostics information to predict issues and take corrective action to reduce downtime and maintenance costs.

There are literally dozens of root causes for damage to a pump and related failure, such as cavitation damage, the failure of seals, bearings or other internals, misaligned or imbalanced installation.

Instead of monitoring pump vibration status, the present invention provides an active pumping vibration control technique for a variable speed pumping system, in which resonances around critical speeds are detected and avoided automatically during pumping operation. The failure detection and alarm criterions are proposed as well with the real time graphic display, in which each vibration resonance model is presented.

For an over speed pump operation that is now practiced in some specific applications, both the temperature and overall vibration may be raised. The active pump vibration control proposed above may also be applied in these speed regions by checking upon the vibration resonances as well as the overall power spectra rising levels respectively to protect pumps from failure.

To achieve that, the pump vibration power spectra with respect to pump speed may be obtained by a 3-dimensional moving average historic peak detector with respect to pump speed, frequency and temperature change, respectively. A resonance under a critical speed may then be detected and avoided in real time by adjusting proportional/integral/derivative (pid) speed of drive/pump accordingly.

The solution can include a wireless field network communicating continuous real-time Active vibration control, diagnostics, and application data from wireless measurement instruments to the host system's HMI display and data applications.

2. Pump Active Vibration Control

2.1. Pump Vibration Power Spectra Distribution

A pump active vibration control and health monitoring system S is shown schematically in FIG. 1, by way of example, which includes a pump active vibration control C adapted on, or configured in relation to, a pump P, a wireless modem W configured to provide wireless signaling $W_S$, a health monitoring system HMS having a laptop, one or more databases and one or more remote servers.

FIG. 2 shows the pump vibration power spectrum, e.g., including nine (9) different spectrums over nine (9) different time periods labeled $t_1, \ldots, t_3, \ldots, t_5, \ldots, t_8, t_9$.

The power spectra distribution of P with respect to the pump speed of n, the frequency domain of f as well as the temperature change difference of ∇T, may be represented in the form of $$P(n,f,\nabla T)=\varphi(n,f,\nabla T), \tag{1}$$

where φ(n,f,∇T) is an expression of 3-dimensional power spectra distribution with respect to pump speed, time and temperature change, respectively.

With φ(n,f,∇T), the detailed resonances of the pump vibration with respect to pump speed, frequency and temperature change can be analyzed and each dynamic mode may be identified accordingly.

2.2. Discrete Power Spectra Distribution

To achieve the Active vibration control, the pump vibration resonances power spectra of $\hat{P}$ or $\hat{\varphi}$, with respect to pump speed of n, as well as temperature change of ∇T, may be obtained by a peak detector over frequency of f in the frequency domain, which may be represented as $$\hat{P}(n_i,\nabla T)=\hat{\varphi}(n_i,MAHP(f_i\pm\Delta f,\nabla t,\nabla T)), \tag{2}$$

where $n_i=0, \ldots n_{max}$ within a speed region, $MAHP(f_i\pm\Delta f, \nabla t,\nabla T)$ is a 3-dimensional moving average historic peak detector with its center frequency at $f_i$ which is associated with pump speed of $n_i$, and with the filter lengths of $\pm\gamma f$ along frequency, ∇t along time, and the temperature change of ∇T, where the power spectra is combined over fractional octave bands with respect to the pump speed of n.

2.3. Pump Active Vibration Control

Therefore, the Active vibration control with respect to pump speed of n based upon Eq. 2 may be derived as following.

The pump speed of n may be fixed at a value of $n_{trig}$, as $$n=n_{trig} \tag{3}$$

when the power spectra has a jump of $\Delta\hat{P}$ which is greater than a power spectra threshold value of $\Delta\hat{P}_{Thr\ i}$ set for detecting a resonance at the band of i, i.e., $$\Delta\hat{P}\geq\Delta\hat{P}_{Thr\ i}, \tag{4}$$

together with a temperature criterion defined as $$\nabla T\geq\nabla T_{Thr\ i}, \tag{5}$$

where $\nabla T_{thr\ i}$ is a temperature change threshold value set up, and $\Delta\hat{P}$ may be defined in form of $$\Delta\hat{P}(n_i,\nabla T)=abs(\hat{\varphi}(n_i,\nabla T)-\overline{\varphi}), \tag{6}$$

where $\Delta\hat{P}$ is the power spectrum jump in between $\hat{\varphi}$ at speed of $n_i$, and $\nabla T$, $\overline{\varphi}$ is the overall average power spectra along speed of n, at the time of t, and over the temperature change of $\nabla T$, respectively.

A trig flag is raised as "true" accordingly.

The pump speed resume to pid control on speed of n, whenever there is no resonance triggered, i.e., $\Delta\hat{P}<\Delta\hat{P}_{Thr\ i}$, and the trig flag is set "false", respectively.

In general, the pump speed is frozen at $n_{trig}$ momentarily whenever a resonance-trigger signal triggered, and resumes back to the pid function speed control soon after the trigger signal is vanished.

By way of example, FIG. 3 shows a flow chart and modules generally indicated as 1 for implementing the active pump control signal processing, according to some embodiments of the present invention. In FIG. 3, the active pump control signal processing may be implemented, e.g., using an Acc (e.g., an accumulator) 2, a IIR High Pass (HP) 10 Hz cutoff module 3, Low Pass (LP) 500 Hz cutoff module 4, a Fast Fourier Transform (FFT) module 5, a moving average historic peak (MAHP) detector module 6 and a decision making module 7, consistent with that set forth herein. In operation, the decision making module 7 is configured to provide decision signaling to adjust the pump speed to $n=n_{trig}$ if $\Delta\hat{P}\geq\Delta\hat{P}_{Thr\ i}$ and $\nabla T\geq\nabla T_{thr\ i}$ is true (i.e. Yes); and to provide corresponding decision signaling to adjust the pump speed to n=n if $\Delta\hat{P}\geq\Delta\hat{P}_{Thr\ i}$ and $\nabla T\geq\nabla T_{thr\ i}$ is false (i.e. No).

Note that the temperature change threshold condition of Eq. 5 is only for over speed operation to protect the motor and pump failure.

2.4. Failure Prevention

An individual modes failure detection and alarm may be expressed in form of $$\Delta\hat{P}(n_i,\nabla T)\geq\Delta\hat{P}_{Thr\ i}, \tag{7}$$

$$\nabla T\geq\nabla T_{thr\ i}, \tag{8}$$

where $$\Delta\hat{P}(n_i\nabla T)=abs(\hat{\varphi}(n_i,\nabla T)-\overline{\varphi}_0), \tag{9}$$

where $\hat{\varphi}(n_i, \nabla T)$ is the power spectra combined over fractional octave bands with respect to the pump speed of n, and $\overline{\varphi}_0$ is the overall power averaged over the pump speed at the beginning of the pump installation.

The failure detection and alarm may be expressed in form of the overall power spectra as $$\Delta\overline{P}_{overall}\geq\Delta\overline{P}_{Thr\ all}, \tag{10}$$

and $$\nabla T\geq\nabla T_{thr\ all}, \tag{11}$$

Where $$\Delta\hat{P}_{overall}=abs(\overline{\varphi}-\overline{\varphi}_0) \tag{12}$$

where $\overline{\varphi}$ is the overall power spectrum averaged over the pump speed, and $\overline{\varphi}_0$ is the overall power averaged over the pump speed at the beginning of the pump installation, $\Delta\hat{P}_{Thr\ all}$ the overall threshold for vibration.

Equations 7-12 may be used for active pump vibration control as well, especially for the over speed operation, when the overall power spectrum averaged over the pump speed may exceed their thresholds set up, while checking upon any resonances to avoid as well the same as for the resonances handled in the normal operation speed region in Equations 3-6.

Varying pump speed may be realized by staging or destaging a pump to pump system to avoid the over vibration introduced by over speeding operation.

In addition, to pin point a failure mode with a specific part, as the best practice for calling a service, the system dynamic analysis for the pump together with hydronic system should be carried out as well, ahead of time. Therefore, the exact relationship of the parts and the bands alarmed are known specifically to the control system.

FIG. 4

According to some embodiments, the present invention may include, or take the form of, apparatus 10 featuring a controller 11 having a signal processor or processing module 10*a* configured to:

receive signaling containing information about receive signaling containing information about a relationship between frequencies of pump vibration resonances detected around critical pump speeds and a 3-dimensional pump vibration power spectrum in the frequency domain with respect to pump speed and pump temperature change differences; and determine corresponding signaling containing information to adjust the pump speed to avoid the pump vibration resonances around the critical pump speeds, based upon the signaling received, based upon the signaling received.

The signal processor or processing module 10*a* may be configured to provide the corresponding signaling as control signaling to adjust the pump speed.

The Controller 11

By way of example, the functionality of the controller 11 may be implemented using hardware, software, firmware, or a combination thereof. In a typical software implementation, the controller would include one or more microprocessor-based architectures having, e. g., at least one signal processor or microprocessor like element 10*a*. A person skilled in the art would be able to program such a microcontroller (or microprocessor)-based implementation to perform the functionality described herein without undue experimentation. The scope of the invention is not intended to be limited to any particular implementation using technology either now known or later developed in the future. The scope of the invention is intended to include implementing the functionality of the processors 10*a* as stand-alone processor or processor module, as separate processor or processor modules, as well as some combination thereof.

The apparatus 10 and/or controller 11 may also include other signal processor circuits or components 10*b*, e.g. including memory modules like random access memory (RAM) and/or read only memory (ROM), input/output devices and control, and data and address buses connecting the same, and/or at least one input processor and at least one output processor.

The apparatus 10 may also include other circuitry and components 10*c*, including sensors for detecting pump speed, pump vibration, pump temperature, e.g., such as accelerometers, thermistors, etc.

By way of example, the 3-dimensional pump vibration power spectrum may be suitably sensed. The sensed signaling may be suitably processed using the modules 3, 4, 5 and 6 in FIG. 3, and suitably stored in one or more memory modules that may form part of the circuits or components 10*b*. The 3-dimensional pump vibration power spectrum may also be suitably updated and adapted over time consistent with that set forth herein.

By way of further example, the functionality of the controller 11 may be implemented in whole or in part in the pump active vibration control C (FIG. 1), the health monitoring system HMS (FIG. 1), or some combination thereof, according to some embodiments of the present invention.

Various Embodiments

The present invention may be implemented in one or more different embodiments, e.g., consistent with that set forth below:

According to some embodiments, the present invention may include, or take the form of, a variable speed pumping control system with active temperature and vibration monitoring and control means having primarily a variable speed pumping control system with active temperature and vibration monitoring and control device, which is capable for active pump vibration control and failure detection for a pumping hydronic system with a VFD drive. The active pump vibration control may be primarily realized by on-operation vibration and temperature elevation detection by voiding the resonance speeds directly and/or simply by alternating pump speed for a certain rising levels based upon their overall vibration power spectra not only for normal operation, but also for over speed pump operation as well.

According to some embodiments, the present invention may include, or take the form of, the active temperature and vibration monitoring and control means having a 3-dimensional moving average historic peak detector, an automatic resonance detector, a pump/drive speed altering module, and a failure mode evaluation module with associated their real time spectra display and alarming of $$\hat{P}(n_i, \nabla T).$$

According to some embodiments, the present invention may include, or take the form of, the 3-dimensional moving average historic peak detector for the active pumping vibration control and monitoring means having the form of $MAHP(f_i \pm \Delta f, \nabla T)$ with its center frequency at $f_i$ and the filter lengths of $\pm\Delta f$ along frequency and $\nabla T$ along the time. The power spectra may be combined over fractional octave bands with respect to the pump speed of n.

According to some embodiments, the present invention may include, or take the form of, the automatic resonance detector for the active pumping vibration control and monitoring means having the form of $\Delta\hat{P}(n_i) \geq \Delta\hat{P}_{Thr\ i}$ and $\nabla T \geq \nabla T_{thri}$, with $\Delta\hat{P}(n_i, \nabla T) = abs(\hat{\varphi}(n_i, \nabla T) - \overline{\varphi}_0)$. Here, $\hat{\varphi}(n_i)$ is the power spectra combined and averaged over the pump speed of n, $\overline{\varphi}_0$ is the overall power averaged over the pump speed at the beginning of the pump installation, and the power spectra threshold values of $\Delta\hat{P}_{Thr\ i}$ and $\nabla T_{thri}$ sets for detecting a resonance at the band of i.

Alternatively, according to some embodiments, the present invention may include, or take the form of, the automatic resonance detector for the active pumping vibration control and monitoring means having the form of $\Delta\hat{P}_{overall} \geq \Delta\hat{P}_{Thr\ all}$ and $\nabla T \geq \nabla T_{thr\ all}$, with $\Delta\hat{P}_{overall} = abs(\overline{\varphi} - \overline{\varphi}_0)$. Here, $\overline{\varphi}$ is the overall power spectrum averaged over the pump speed, $\overline{\varphi}_0$ is the overall power averaged over the pump speed at the beginning of the pump installation, and the power spectra threshold values of $\Delta\hat{P}_{Thr\ all}$ and $\nabla T_{thr\ all}$ sets for detecting a resonance at the band of i.

Alternatively, according to some embodiments, the present invention may include, or take the form of, the active temperature and vibration monitoring and control means having the active pump vibration control specially for the over speed operation, when the overall power spectrum and temperature may exceed thresholds set up the same as represented in Eqs. 7-12, for avoiding the resonances as well as their overall spectra limits.

According to some embodiments, the present invention may include, or take the form of, the active temperature and vibration monitoring and control means having the graphic real time spectra display and alarming, in which the vibration spectra, the overall power spectra averaged over the pump speed, temperature, as well as their corresponding thresholds are displayed graphically in real time.

According to some embodiments, the present invention may include, or take the form of, the active temperature and vibration monitoring and control means having system dynamic analysis data acquired for the pump together with the hydronic system and integrated to the control system, which shows the exact relationship between the parts and the bands alarmed, to pin point a failure mode with a specific part for calling a service.

According to some embodiments, the present invention may include, or take the form of, the active temperature and vibration monitoring and control means having all close loop or open loop hydronic pumping systems, such as primary pumping systems, secondary pumping systems, water circulating systems, and pressure booster systems. The systems mentioned here may consist of a single zone or multiple zones as well.

According to some embodiments, the present invention may include the vibration sensors, e.g., such as any accelerators, mems sensors, and so forth.

According to some embodiments, the present invention may include control signals transmitting and wiring technologies, e.g., such as all conventional sensing and transmitting means that are used currently in the art, as well as those later developed in the future. Preferably, wireless sensor signal transmission technologies would be optimal and favorable.

According to some embodiments, the present invention may include pumps for the hydronic pumping systems, e.g., such as a single pump, a circulator, a group of parallel ganged pumps or circulators, a group of serial ganged pumps or circulators, or their combinations.

REFERENCES

This application forms part of a family of technologies, as follows:

Reference [1]: [911-019-001-2 (F-B&G-1001US)], by Andrew Cheng, James Gu, entitled "Method and Apparatus for Pump Control Using Varying Equivalent System Characteristic Curve, a/k/a an Adaptive Control Curve," issued as U.S. Pat. No. 8,700,221, on 15 Apr. 2014.

Reference [2]: [911-019-004-2 (F-B&G-X0001 US01)], by Andrew Cheng, James Gu, Graham Scott, entitled "Dynamic Linear Control Methods And Apparatus For Variable Speed Pump Control," issued as U.S. Pat. No. 10,048,701, on 14 Aug. 2018.

Reference [3]: [ 911-019-012-2 (F-B&G-X0010US01], by Andrew Cheng, James Gu, Graham Scott, entitled "Sensorless Adaptive Pump Control with Self-Calibration Apparatus for Hydronic Pumping Systems" issued as U.S. Pat. No. 9,897,084, on 20 Feb. 2018.

Reference [4]: [ 911-019.015-3 (F-B&G-X0012WO)], by Andrew Cheng, James Gu, Graham Scott, entitled "System and Flow Adaptive Pumping Control Apparatus—A Minimum Pumping Energy Operation Control System vs. Sensorless Application," issued as U.S. Pat. No. 9,846,416, on 19 Dec. 2017.

Reference [5]: [911-019-019-1 (F-B&G-X0016US], by Andrew Cheng, James Gu, entitled "No Flow Detection Means for Sensorless Pumping Control Applications," issued as U.S. Pat. No. 10,317,894, on 11 Jun. 2019.

Reference [6]: [911-019-022-2 (F-B&G-X0022US01], by Andrew Cheng, James Gu, Kyle Schoenheit, entitled "Advanced Real Time Graphic Sensorless Energy Saving Pump Control System," filed on 22 Jul. 2016, and assigned Ser. No. 15/217,070, which claims benefit to provisional application Ser. No. 62/196,355, filed 24 Jul. 2015.

Reference [7]: [911-019-034-1 (F-B&G-X0022US], by Andrew Cheng, Matt Ruffo and Ruff Jordan, entitled "Adaptive Water Level Controls For Water Empty Or Fill Applications," filed on 21 Mar. 2018, and assigned Ser. No. 15/927,296, which claims benefit to provisional application Ser. No. 62/196,355, filed 21 Mar. 2017.

All of the aforementioned patents and patent applications are incorporated by reference in their entirety.

THE SCOPE OF THE INVENTION

The embodiments shown and described in detail herein are provided by way of example only; and the scope of the invention is not intended to be limited to the particular configurations, dimensionalities, and/or design details of these parts or elements included herein. In other words, one skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein.

Although the invention has been described and illustrated with respect to exemplary embodiments thereof, the foregoing and various other additions and omissions may be made therein and thereto without departing from the spirit and scope of the present invention.

What we claim is:

1. Apparatus comprising:

a controller having a signal processor or processing module configured to:

receive signaling containing information about a relationship between frequencies of pump vibration resonances detected around critical pump speeds and a 3-dimensional pump vibration power spectrum in the frequency domain with respect to pump speed and pump temperature change differences; and determine corresponding signaling containing information to adjust the pump speed to avoid the pump vibration resonances around the critical pump speeds, based upon the signaling received.

2. Apparatus according to claim 1, wherein the signal processor or processing module is configured to provide the corresponding signaling as control signaling to adjust the pump speed.

3. Apparatus according to claim 1, wherein the apparatus comprises a variable speed pumping control system.

4. Apparatus according to claim 1, wherein the controller comprises a moving average historic peak detector configured to receive associated signaling containing information about the pump speed, the frequencies of the pump vibration resonances detected, and the pump temperature change differences, and detect and provide moving average historic peaks.

5. Apparatus according to claim 1, wherein the moving average historic peak detector is a 3-dimensional moving average historic peak detector.

6. Apparatus according to claim 1, wherein the 3-dimensional pump vibration power spectrum of P with respect to the pump speed of n, the frequency domain of f and the temperature change difference of ∇T takes the form of the following equation:

$$P(n,f,\nabla T)=\varphi(n,f,\nabla T), \tag{1}$$

where the expression $\varphi(n,f,\nabla T)$ is a 3-dimensional power spectra distribution with respect to pump speed of n, time and temperature change difference of ∇T, respectively.

7. Apparatus according to claim 6, wherein the controller comprises a moving average historic peak detector configured to obtain moving average historic peaks over frequency of f in the frequency domain, using the equation:

$$\hat{P}(n_i,\nabla T)=\hat{\varphi}(n_i,MAHP(f_i\pm\Delta f,\nabla t,\nabla T)), \tag{2}$$

where $n_i=0, \ldots, n_{max}$ within a speed region, MAHP $(f_i\pm\Delta f,\nabla t,\nabla T)$ is a 3-dimensional moving average historic peak detector with its center frequency at $f_i$ which is associated with a given pump speed of $n_i$, and with filter lengths of $\pm\Delta f$ along frequency, ∇t along time, and the temperature change difference of ∇T, where the 3-dimensional power spectra distribution is combined over fractional octave bands with respect to the pump speed of n.

8. Apparatus according to claim 7, wherein the controller is configured to implement an active vibration control with respect to the pump speed of n based upon Eq. 2 as follows:

fixing the pump speed of n at a value of $n_{tria}$, as $$n=n_{tria} \tag{3}$$

determining when a power spectrum jump of $\Delta\hat{P}$ is greater than a power spectra threshold value of $\Delta\hat{P}_{Thr\ i}$ set for detecting a resonance at a band of i, based upon the relationship:

$$\Delta\hat{P}\geq\Delta\hat{P}_{Thr\ i}; \tag{4}$$

defining a temperature criterion as $$\nabla T\geq\nabla T_{thr\ i}, \tag{5}$$

where $\nabla T_{thr\ i}$ is a temperature change threshold value set up; and defining the power spectrum jump of $\Delta\hat{P}$ by the equation:

$$\Delta\hat{P}(n_i,\nabla T)=abs(\hat{\varphi}(n_i,\ \nabla T)-\overline{\varphi}), \quad (6)$$

where $\Delta\hat{P}$ is the power spectrum jump in between $\hat{\varphi}$ at speed of $n_i$ and $\nabla T$, $\overline{\varphi}$ is an overall average power spectra along the pump speed of n, at a time of t, and over the temperature change difference of $\nabla T$, respectively.

9. Apparatus according to claim 8, wherein the controller is also configured to implement the active vibration control by resuming the pump speed of n whenever there is no resonance triggered if $\Delta\hat{P}<\Delta\hat{P}_{Thr\ i}$, and setting the trig flag from "true" to "false", respectively.

10. Apparatus according to claim 1, wherein the signal processor or processing module is configured to provide the corresponding signaling as control signaling to control the operation of a pumping system, including staging/destaging a pump to or from the pumping system.

11. A method comprising:

receiving, with a controller having a signal processor or processing module, signaling containing information about a relationship between frequencies of pump vibration resonances detected around critical pump speeds and a 3-dimensional pump vibration power spectrum in the frequency domain with respect to pump speed and pump temperature change differences; and determining, with the controller, corresponding signaling containing information to adjust the pump speed to avoid the pump vibration resonances around the critical pump speeds, based upon the signaling received.

12. A method according to claim 11, wherein the method comprises providing with the signal processor or processing module the corresponding signaling as control signaling to adjust the pump speed.

13. A method according to claim 11, wherein the method comprises implementing the apparatus in the form of a variable speed pumping control system.

14. A method according to claim 11, wherein the method comprises implementing in the controller a moving average historic peak detector configured to receive associated signaling containing information about the pump speed, the frequencies of the pump vibration resonances detected, and the pump temperature change differences, and detect and provide moving average historic peaks.

15. A method according to claim 11, wherein the method comprises implementing the moving average historic peak detector in the form of a 3-dimensional moving average historic peak detector.

16. A method according to claim 11, wherein the method comprises implementing the 3-dimensional pump vibration power spectrum of P with respect to the pump speed of n, the frequency domain of f and the temperature change difference of $\nabla T$ using the following equation:

$$P(n,f,\nabla T)=\varphi(nf,\nabla T), \quad (1)$$

where the expression $\varphi(n,f,\nabla T)$ is a 3-dimensional power spectra distribution with respect to pump speed of n, time and temperature change difference of $\nabla T$, respectively.

17. A method according to claim 16, wherein the method comprises configuring the controller with a moving average historic peak detector to obtain moving average historic peaks over frequency of f in the frequency domain, using the equation:

$$\hat{P}(n_i,\nabla T)=\hat{\varphi}(n_i,\ MAHP(f_i\pm\Delta f,\nabla t,\nabla T)), \quad (2)$$

where $n_i=0, \ldots, n_{max}$ within a speed region, MAHP $(f_i\pm\Delta f,\nabla t,\nabla T)$ is a 3-dimensional moving average historic peak detector with its center frequency at $f_i$ which is associated with a given pump speed of $n_i$, and with filter lengths of $\pm\Delta f$ along frequency, $\nabla t$ along time, and the temperature change difference of $\nabla T$, where the 3-dimensional power spectra distribution is combined over fractional octave bands with respect to the pump speed of n.

18. A method according to claim 17, wherein the method comprises configuring the controller to implement an active vibration control with respect to the pump speed of n based upon Eq. 2 as follows:

fixing the pump speed of n at a value of $n_{tria}$, as $$n=n_{tria} \quad (3);$$

determining when a power spectrum jump of $\Delta\hat{P}$ is greater than a power spectra threshold value of $\Delta\hat{P}_{Thr\ i}$ set for detecting a resonance at a band of i, based upon the relationship:

$$\Delta\hat{P}\geq\Delta\hat{P}_{Thr\ i}; \quad (4)$$

defining a temperature criterion as $$\nabla T\geq\nabla T_{thr\ i}, \quad (5)$$

where $\nabla T_{thr\ i}$ is a temperature change threshold value set up; and defining the power spectrum jump of $\Delta\hat{P}$ by the equation:

$$\Delta\hat{P}(n_i,\nabla T)=abs(\hat{\varphi}(n_i,\ \nabla T)-\overline{\varphi}), \quad (6)$$

where $\Delta\hat{P}$ is the power spectrum jump in between $\hat{\varphi}$ at speed of $n_i$ and $\nabla T$, $\overline{\varphi}$ is an overall average power spectra along the pump speed of n, at a time of t, and over the temperature change difference of $\nabla T$, respectively.

19. A method according to claim 18, wherein the method comprises configuring the controller to implement the active vibration control by resuming the pump speed of n whenever there is no resonance triggered if $\Delta\hat{P}<\Delta\hat{P}_{Thr\ i}$, and setting the trig flag from "true" to "false", respectively.

20. A method according to claim 11, wherein the method comprises providing with the signal processor or processing module the corresponding signaling as control signaling to control the operation of a pumping system, including staging/destaging a pump to or from the pumping system.

* * * * *